United States Patent [19]

Rodgers

[11] 3,964,543

[45] June 22, 1976

[54] UNDERWATER WELLHEAD COMPLETIONS WITH PORTABLE ATMOSPHERIC CELLAR

[75] Inventor: James T. Rodgers, New Orleans, La.

[73] Assignee: Standard Oil Company (Indiana), Chicago, Ill.

[22] Filed: Nov. 18, 1974

[21] Appl. No.: 525,046

[52] U.S. Cl. ..... 166/.5; 61/69 A

[51] Int. Cl.[2] ..... E21B 43/01

[58] Field of Search ..... 175/5–10; 166/.5, .6; 61/46, 46.5, 69

[56] References Cited

UNITED STATES PATENTS

| | | | |
|---|---|---|---|
| 2,854,215 | 9/1958 | Cox, Jr. et al. | 166/.5 X |
| 2,965,174 | 12/1960 | Haeber | 166/.5 |
| 2,988,144 | 6/1961 | Conrad | 166/96 X |
| 3,202,218 | 8/1965 | Watts et al. | 166/.5 |
| 3,379,245 | 4/1968 | Manning | 61/46 X |
| 3,380,520 | 4/1968 | Pease | 166/.5 |
| 3,395,755 | 8/1968 | Manning | 175/8 X |
| 3,512,583 | 5/1970 | James | 166/.5 |
| 3,527,294 | 9/1970 | Weiss et al. | 166/.5 |
| 3,626,701 | 12/1971 | Laffont | 175/7 X |
| 3,665,721 | 5/1972 | Wyllie | 175/9 |

*Primary Examiner*—Ernest R. Purser
*Assistant Examiner*—Richard E. Favreau
*Attorney, Agent, or Firm*—John D. Gassett; Paul F. Hawley

[57] ABSTRACT

This invention concerns means for protecting a marine wellhead (including the Christmas tree) on an offshore hydrocarbon-producing platform from damage due to fire. Special means are provided to place the wellhead a small depth, e.g., 25 to 50 feet, below the water surface under the deck of the offshore platform. These special means include a horizontal plate supported by the platform and sealed to the upper end of the casing. A cylindrical housing, called a "portable cellar," is lowered from the platform and seals with the horizontal plate. The cellar housing extends above the surface of the water. Water is then pumped out of the sealed cellar so that work on or through the wellhead can be done in a normal open-air environment. After the operation is performed on or through the wellhead, the cellar is removed, the water again surrounds the marine wellhead, so that, in case of fire, it cannot be damaged by heat.

7 Claims, 4 Drawing Figures

UNDERWATER WELLHEAD COMPLETIONS WITH PORTABLE ATMOSPHERIC CELLAR

RELATED APPLICATION

U.S. patent application, Ser. No. 525,041, filed Nov. 18, 1974, entitled "Subsurface Wellhead Shield," by Robert M. Peevey, relates to a similar problem, as does this specification.

BACKGROUND OF THE INVENTION

Field of the Invention

This invention relates to an offshore platform for producing oil from a well drilled to an underground hydrocarbon reservoir beneath the body of the water in which the platform is located. It relates especially to a structure for protecting the wellhead and the platform from damage due to fire. The term "wellhead", as used here, includes the "Christmas tree", which, in turn, includes the master valves, tee, swab valves, and wing valves, which sit on top of the casing spool and hanging equipment. It concerns particularly the placing of the wellhead beneath the surface of the body of the water and includes means whereby the wellhead can be sealed to a cylindrical cellar which extends above the water and from which the water can be removed so that the wellhead is in an atmospheric environment.

Setting of the Invention

In recent years, there has been considerable attention attracted to the drilling and production of oil and gas wells located in water. Wells may be drilled in the ocean floor from either fixed platforms in relatively shallow water or from floating structures or vessels in deeper water. The most used means is the fixed platform which includes the driving or otherwise anchoring of long piles in the ocean floor. Such piles extend above the surface of the water with the working deck or platform attached to the top of the piles. In using such fixed platforms, the drilling rig is set on the platform above the surface of the water and the wells are normally drilled using generally dry land techniques. After the well is drilled, producing equipment, separators, wellheads, and the like, are located on the platform itself above the surface of the water. There are usually many wells, e.g., 8 to 16, drilled from one offshore platform and a corresponding number of wellheads. One problem with this particular type setup is the danger of damage to the wellheads by fire. There has been at least one instance that a fire occurred and the wellheads worked perfectly in shutting off the flow of fluid, but excessive heat from the burning of petroleum being processed or fuel stored on the deck of the platform itself damaged the wellheads so they leaked. The fire would have burned itself out as soon as stored fuel or petroleum on the platform was exhausted except for the fact that the fire and heat damaged the wellheads causing them to leak and add more fuel to the fire. This, of course, resulted in the wells producing uncontrolled and the fire continuing for weeks until such time as the wells were killed by drilling directional wells for bottom-hole control. This is a tremendous loss of natural resources and also a tremendous expense. Presently, there is a reluctance in the offshore industry to include normal production equipment on the same platform structure with the producing well wellheads. This reluctance is based on safety considerations, primarily to prevent exposing the producing wellheads to fire or high temperatures resulting from fire. As an alternative, therefore, the industry is often setting two platforms side by side with the wells on one platform and the production equipment on the other. Needless to say, this is a significant added investment over a single platform installation.

The present invention is directed toward one means of preventing such a fire from damaging the wellhead and does not require a second platform.

Prior Art

No prior art is known which describes the invention claimed herein. There is considerable art in the field of offshore producing platforms. Some related art, dealing with installing controls and operating underwater wells, includes U.S. Pat. Nos. 2,970,646; 3,395,755; and Canadian Pat. No. 890,146. All of these patents are concerned with an undersea well where the wellhead controls are on the sea floor, and none of them is concerned with fixed offshore platforms, such as is the situation in this specification.

BRIEF SUMMARY OF THE INVENTION

This invention concerns an offshore platform for producing hydrocarbons from an underground formation under the bottom of a body of water. The platform includes piles which were driven into the bottom of the body of water and extend to above the surface where they support a work deck or a gravity base. A wellhead base is supported by the platform beneath the deck below the surface of the body of water, e.g., 25 to 50 feet. The casing extends through this wellhead base in a sealing relationship therewith. The normal Christmas tree is mounted on top of the casing just above the wellhead base. A portable cellar or well servicing cylinder normally open at both ends is provided and can be lowered from the work deck to rest on the wellhead base with the lower edge of the cellar seating on and sealing with the wellhead base. When it is desired to service the well, the portable cellar is lowered into position on the wellhead base and the water is pumped out of the cellar. The cellar is open at the upper end and extends above the surface of the body of water. Once the water is removed from the cellar, the wellhead can be serviced or operations performed therethrough in a manner similar to operations as if it were on the working deck of the offshore platform itself. When the servicing operations are through, the portable wellhead cellar is removed and the wellhead is once more submerged under water. Thus, even in the case of a very severe fire, the wellhead is protected from excessive heat.

BRIEF DESCRIPTION OF THE DRAWINGS

A better understanding of the invention and various modifications and objects thereof can be made with the following description taken in conjunction with the drawings in which.

DETAILED DESCRIPTION OF THE INVENTION

Figure 1:
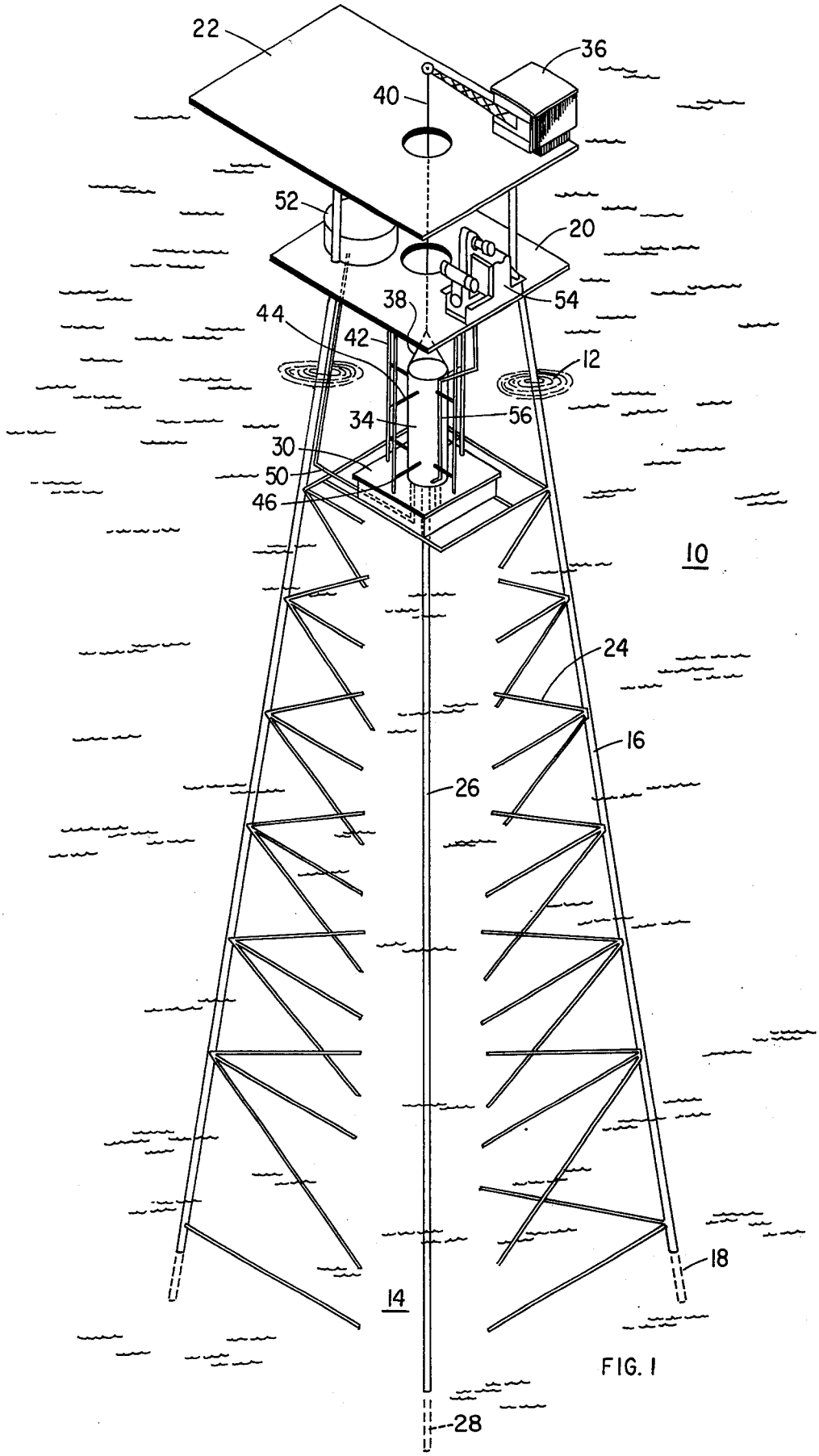
FIG. 1 is an isometric view of an offshore production platform featuring an embodiment of this invention.

Attention is first directed to FIG. 1 which shows a platform in a body of water 10 which has a surface 12 and a bottom 14. Legs or piling 16 are driven into the ocean bottom 14, as indicated by dotted lines 18. Piling 16 continues above the surface 12 of the water and supports a first or lower deck 20 and an upper deck 22. Cross bracing 24 connects legs 16 to give them added rigidity. A drive pipe 26 extends from a well indicated by dotted lines 28 which has been drilled in the bottom of the body of water to wellhead base 30 near the surface of the body of water. In FIG. 1, the front leg 16 is "cutaway" so that drive pipe 26 can be shown. In the conventional completion procedures on offshore platforms, the drive pipe 26 would extend to above the water to platform 20. The tubing or the producing string of pipe through which petroleum is produced is contained within drive pipe 26 and other strings of casing and extends downwardly to the underground producing formation or reservoir.

Figure 3:
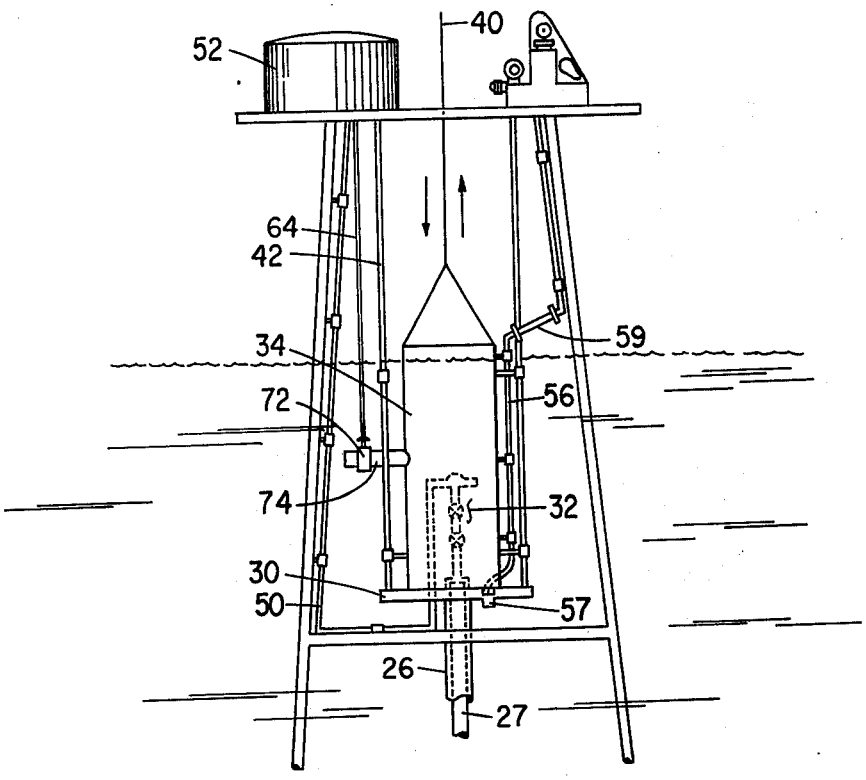
FIG. 3 illustrates a modification of the wellhead cellar of FIG. 1.
Figure 2:
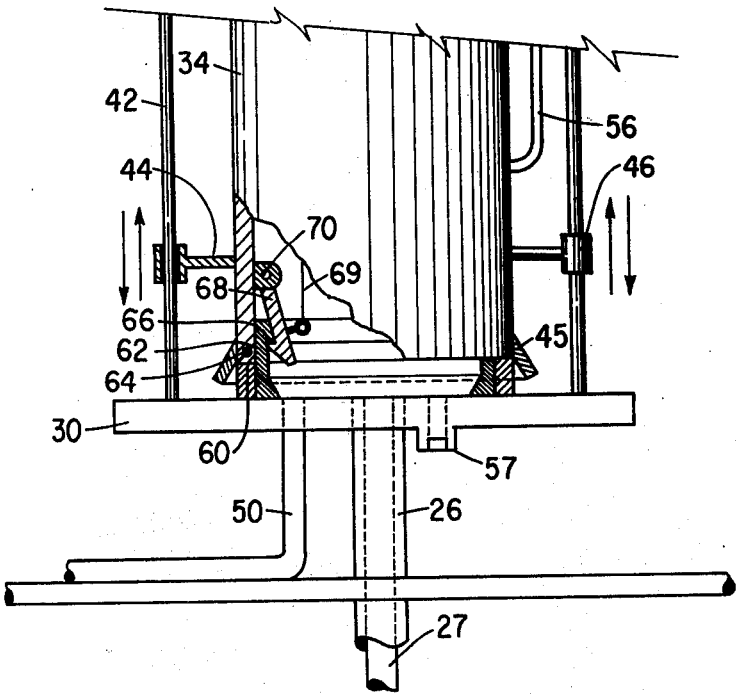
FIG. 2 illustrates a latching and sealing means between the protecting cellar and the wellhead base.

As shown in FIG. 3, drive pipe 26 surrounds casing 27 and both extend through wellhead plate or base 30 and the outer wall of the drive pipe 26 is sealed to the baseplate 30 whch lands on the top of the drive pipe. The drive pipe is cut off at a predetermined depth below the water to receive the casing and baseplate. The usual wellhead is connected to the upper end of drive pipe 26, as indicated by dotted lines or configuration 32 in FIG. 3. Only one drive pipe 26 and one wellhead are shown. However, there will ordinarily be many such wells and wellheads for each offshore platform. Referring back to FIG. 1, a cylindrical cellar housing 34 is shown seated on wellhead base 30. The wellhead is indicated to be within cellar 34. The cellar is removable and is raised or lowered by crane 36, which is shown on upper deck 22. The upper end of the cellar 34 is open and has lifting line 38 which connect with line 40 of crane 36. Vertical guide means 42 are provided and guide arms 44 are secured to the housing 34 and the outer ends of arms 44 are provided with guide sleeves 46 which slide along guidelines 42. As shown in FIG. 2, cellar 34 can be provided at its lower end with inverted funnel 45 to make alignment easier. These are to assure that the cylindrical housing 34 is properly aligned with the sealing means to be described later on wellhead base 30. Also shown in FIG. 1 is a production line 50 which extends through wellhead base 30 and connects with the wellhead by means not shown and extends to producing equipment indicated by 52 on lower deck 20. A water removal pump 54 is also located on deck 20. A suction line 56 which goes down the side at housing 34 and into sump 57 in baseplate 30 within cylinder 34 for removing water therefrom. Suction line 56 can include hose 59 for ease of connecting to pump 54.

Attention is next directed to FIG. 2 which shows a partial cutaway view of the portable cellar 34 and baseplate 30 to illustrate the sealing and latching means between the two. In the embodiment shown in FIG. 2 wellhead base 30 has an upwardly facing annular shoulder 60 which mates with a downwardly facing surface 62 on portable cellar 34. A seal 64 is provided between the two to insure a better seal. A downwardly facing annular shoulder 66 is secured to base 30 and provides a point of latching for latching arm 68 which is pivotally attached at 70 to the inner wall of portable cellar 34. Remote disconnect means are provided for latch 68 and can be simply a line 69. Although latching means may not always be necessary, it is preferred to have them. Any of many well known latching means can be used which can be latched remotely or manually.

Attention is next directed to FIG. 3 which shows a modification of the invention illustrated in FIG. 1. Shown thereon is portable cylinder 34 set in place on baseplate 30. A conduit 74 extends through the wall of portable cellar 34. A valve 72 is in conduit 70 and is remotely controlled from the surface through control line 64. The purpose of conduit 74 and valve 72 is to permit the interior of portable cellar 34 to be flooded while it is still in place on wellhead baseplate 30. When it is desired to have the interior of portable cellar 34 dry, all that is necessary to do in the embodiment of FIG. 3 is to close valve 72 and remove the water through line 56.

Figure 4:
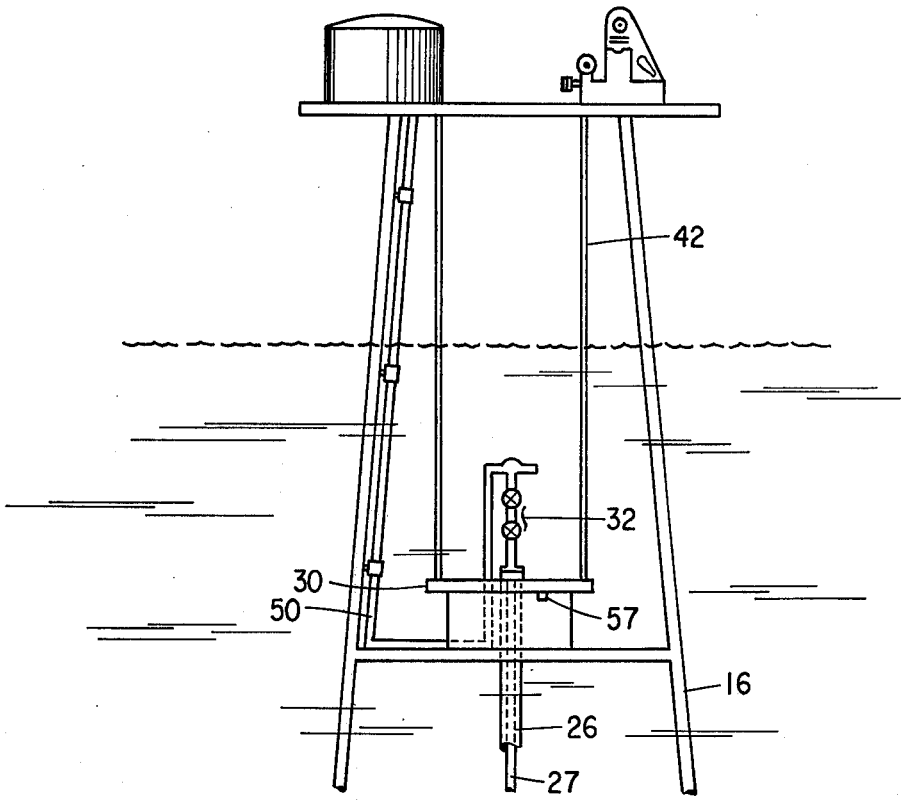
FIG. 4 illustrates the underwater wellhead base with the wellhead cellar removed.

FIG. 4 illustrates the normal operating conditions of the system. As can be seen, wellhead 32 is completely submerged in the body of water with the wellhead cellar 34 removed. In this condition, it is impossible for excessive heat to be applied to the wellhead 32. When it is necessary to do repair work on wellhead 32 or to run wireline tools or other operations in the well, the wellhead cellar 34 is lowered along guidelines 42 to the position shown in FIGS. 1 and 2. Once the lower end of portable cellar 34 is sealed with base 30, the water pump 54 is started and the water is removed from the interior of the portable cellar. As the portable cellar extends above the top of the body of water and is open, the wellhead is then at an atmospheric environment. After the servicing on or through wellhead 32 is completed, I remove portable cellar 34 and return the platform unit to the condition illustrated in FIG. 4.

While the above invention has been described with considerable detail, it is possible to make many modifications thereof without departing from the spirit or the scope of the invention.

I claim:

1. A marine installation for producing fluids from an underground reservoir beneath the bottom of a body of water which comprises:
   - a deck;
   - support means supporting said deck above said body of water;
   - a wellhead base impermeable to water and supported by said support means beneath said deck below the surface of said body of water and above said bottom;
   - a wellhead supported on said wellhead base;
   - a producing line from said wellhead to said deck;
   - a portable cellar for placing over said wellhead, the lower edge of said cellar forming a watertight seal at said wellhead base; and
   - a flowline from said wellhead to said underground reservoir.

2. An installation as defined in claim 1, including a water removal line extending from the surface down to a sump in said wellhead base.

3. An installation as defined in claim 1, including latching means to releasably latch said portable cellar to said wellhead base.

4. An installation as described in claim 1, including guide means between the wellhead base and said deck for guiding said portable cellar into sealing relationship with said wellhead base.

5. A marine installation for producing fluids from an underground reservoir beneath the bottom of a body of water which comprises:

a deck;

support means including piling extending from the bottom of said body of water to above its surface for supporting said deck above said body of water;

a wellhead base supported by said support means beneath said deck below the surface of said body of water and above said bottom;

a wellhead supported on said wellhead base;

a producing line from said wellhead to said deck;

a cylindrical cellar open at its upper and lower ends over said wellhead, the lower edge of said cellar sealing with said wellhead base, the upper edge of said cellar extending above the surface of said body of water when its lower edge is sealing with said wellhead base; and a flowline from said wellhead to said underground reservoir.

6. A marine installation for use with a portable cellar having an open lower end for protecting a wellhead used in producing fluids from an underground reservoir beneath the bottom of a body of water which comprises:

a deck;

support means supporting said deck above said body of water;

a wellhead base impermeable to water and supported by said support means beneath said deck below the surface of said body of water and above said bottom, said wellhead base including means to seal with the lower end of said portable cellar;

a wellhead supported on said wellhead base below the surface of said body of water;

a producing line from said wellhead to said deck; and a flowline from said wellhead to said underground reservoir.

7. A marine installation for producing fluids from an underground reservoir beneath the bottom of a body of water which comprises:

a deck;

support means supporting said deck above said body of water;

a wellhead base impermeable to water and supported by said support means beneath said deck below the surface of said body of water and above said bottom;

a wellhead supported on said wellhead base;

a producing line from said wellhead to said deck;

a portable cellar for placing over said wellhead, the lower edge of said cellar forming a watertight seal at said wellhead base;

a flowline from said wellhead to said underground reservoir;

a conduit below the surface of said body of water and extending through the wall of said portable cellar, and a remotely operated valve means in said conduit.

* * * * *